US011187495B2

(12) United States Patent
Chang

(10) Patent No.: US 11,187,495 B2
(45) Date of Patent: Nov. 30, 2021

(54) COMPENSATING MECHANISM

(71) Applicants: Sintai Optical Co., Ltd., ShenZhen (CN); Asia Optical Co., Inc., Taichung (TW)

(72) Inventor: Ken Chiakan Chang, Taichung (TW)

(73) Assignees: SINTAI OPTICAL (SHENZHEN) CO., LTD., Shenzhen (CN); ASIA OPTICAL CO., INC., Taichung (TW)

( * ) Notice: Subject to any disclaimer, the term of this patent is extended or adjusted under 35 U.S.C. 154(b) by 0 days.

(21) Appl. No.: 17/122,114

(22) Filed: Dec. 15, 2020

(65) Prior Publication Data

US 2021/0223001 A1 Jul. 22, 2021

(30) Foreign Application Priority Data

Jan. 22, 2020 (CN) ..... 202010075753.4

(51) Int. Cl.
*F41G 1/54* (2006.01)

(52) U.S. Cl.
CPC ..... *F41G 1/545* (2013.01)

(58) Field of Classification Search
CPC ..... F41G 1/545
USPC ..... 42/135
See application file for complete search history.

(56) References Cited

U.S. PATENT DOCUMENTS

| | | | | |
|---|---|---|---|---|
| 6,351,907 | B1 * | 3/2002 | Otteman | F41G 1/38 42/120 |
| 8,270,104 | B2 * | 9/2012 | Windauer | F41G 1/38 359/821 |
| 10,684,098 | B2 | 6/2020 | Tang | |
| 2007/0240356 | A1 * | 10/2007 | Klepp | F41G 1/38 42/122 |
| 2008/0066364 | A1 * | 3/2008 | Klepp | F41G 1/38 42/122 |
| 2012/0186131 | A1 * | 7/2012 | Windauer | F41G 1/38 42/122 |
| 2015/0316350 | A1 * | 11/2015 | Hamilton | F41G 1/38 42/122 |
| 2016/0146576 | A1 * | 5/2016 | White | F41G 1/38 42/119 |
| 2017/0211912 | A1 | 7/2017 | Hamilton et al. | |

FOREIGN PATENT DOCUMENTS

| | | | |
|---|---|---|---|
| CN | 105806156 | B | 7/2016 |
| CN | 108779970 | A | 11/2018 |
| CN | 109751916 | A | 5/2019 |
| CN | 209588829 | U | 11/2019 |
| TW | 201823660 | A | 7/2018 |

* cited by examiner

*Primary Examiner* — Samir Abdosh
(74) *Attorney, Agent, or Firm* — McClure, Qualey & Rodack, LLP

(57) ABSTRACT

A compensating mechanism includes a base, an adjusting unit, an adjusting cover and a stop unit. The adjusting unit is disposed in the base. The adjusting cover connects to the adjusting unit and includes a curved groove. The stop unit is disposed between the adjusting unit and the base and includes a pin. When the adjusting cover is rotated, the adjusting unit is only rotated with respect to the base and the stop unit is axially moved with respect to the base so that the pin enters or leaves the curved groove.

20 Claims, 3 Drawing Sheets

COMPENSATING MECHANISM

BACKGROUND OF THE INVENTION

Field of the Invention

The invention relates to a compensating mechanism, and more particularly to a compensating mechanism for a sight.

Description of the Related Art

Generally, a sight is provided with a compensating mechanism for correcting bullet impact points of a firearm. Before the bullet impact points are corrected, it is required to set a compensating mechanism to a zero-point state wherein an adjusting screw of the compensating mechanism is adjusted to a reference position and an adjusting cover of the compensating mechanism is adjusted to a zero-point position. After the zero-point state is set, the user is able to operate the compensating mechanism to correct the bullet impact points of the firearm. However, the adjusting cover may have been rotated many times after a correction of bullet impact points. If correcting bullet impact points for a new target at a different distance is desired afterwards, the user generally has no idea or way to return the compensating mechanism to the zero-point state.

BRIEF SUMMARY OF THE INVENTION

The invention provides a compensating mechanism which is able to perform a zero-point-stop function by use of a stop unit. The compensating mechanism in accordance with an exemplary embodiment of the invention includes a base, an adjusting unit, an adjusting cover and a stop unit. The adjusting unit is disposed in the base. The adjusting cover connects to the adjusting unit and includes a curved groove. The stop unit is disposed between the adjusting unit and the base and includes a pin. When the adjusting cover is rotated, the adjusting unit is only rotated with respect to the base and the stop unit is axially moved with respect to the base so that the pin enters or leaves the curved groove.

In another exemplary embodiment, the compensating mechanism includes a base, an adjusting unit and a stop unit. The adjusting unit is disposed in the base. The adjusting cover connects to the adjusting unit and includes a curved groove. The stop unit is disposed between the adjusting unit and the base and includes a pin. When the adjusting cover is rotated, an axial distance between the adjusting cover and the base is fixed and the stop unit is axially moved with respect to the base so that the pin enters or leaves the curved groove.

In yet another exemplary embodiment, the stop unit further includes a rotary ring disposed around the adjusting unit, the pin is disposed on the rotary ring, and the rotary ring and the pin are axially moved with respect to the base when the adjusting cover is rotated.

In another exemplary embodiment, the rotary ring is rotated with respect to the adjusting unit when the adjusting cover is rotated.

In yet another exemplary embodiment, when rotated, the pin is axially moved with respect to the rotary ring.

In another exemplary embodiment, the base includes a mount cover, the pin includes a flange portion, and the pin is protruded from the mount cover and penetrated into the curved groove when the flange portion is propped against the mount cover.

In yet another exemplary embodiment, the compensating mechanism further includes a fastening screw which is sequentially penetrated through the mount cover and the rotary ring and fixed to the base to prevent the rotary ring from rotating with respect to the base.

In another exemplary embodiment, the mount cover has a through hole, the pin further includes a nut portion and a threaded portion respectively connected to opposite sides of the flange portion, the threaded portion is threaded onto the rotary ring, and the nut portion is penetrated through the through hole of the mount cover.

In yet another exemplary embodiment, an outer diameter of the flange portion is greater than that of the nut portion and also greater than an inner diameter of the through hole.

In another exemplary embodiment, the adjusting cover further comprises a blocking portion, and the blocking portion and the curved groove are configured to form a complete circle.

In yet another exemplary embodiment, the compensating mechanism further includes an adjusting screw disposed in the adjusting unit and penetrated through the base, wherein the adjusting screw is axially moved with respect to the base when the adjusting cover is rotated.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
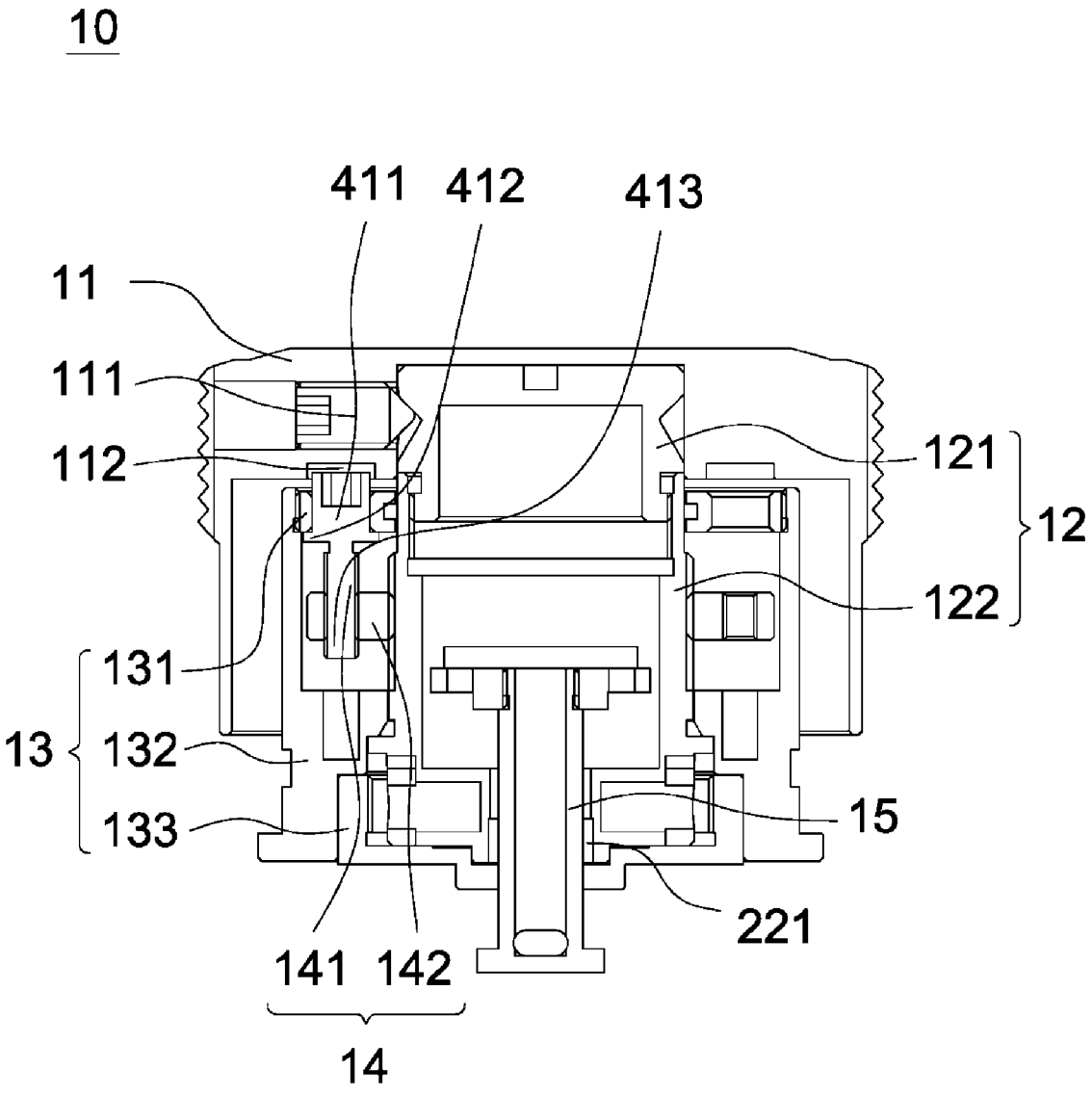
FIG. 1 depicts a section of a compensating mechanism in accordance with an embodiment of the invention
Figure 2:
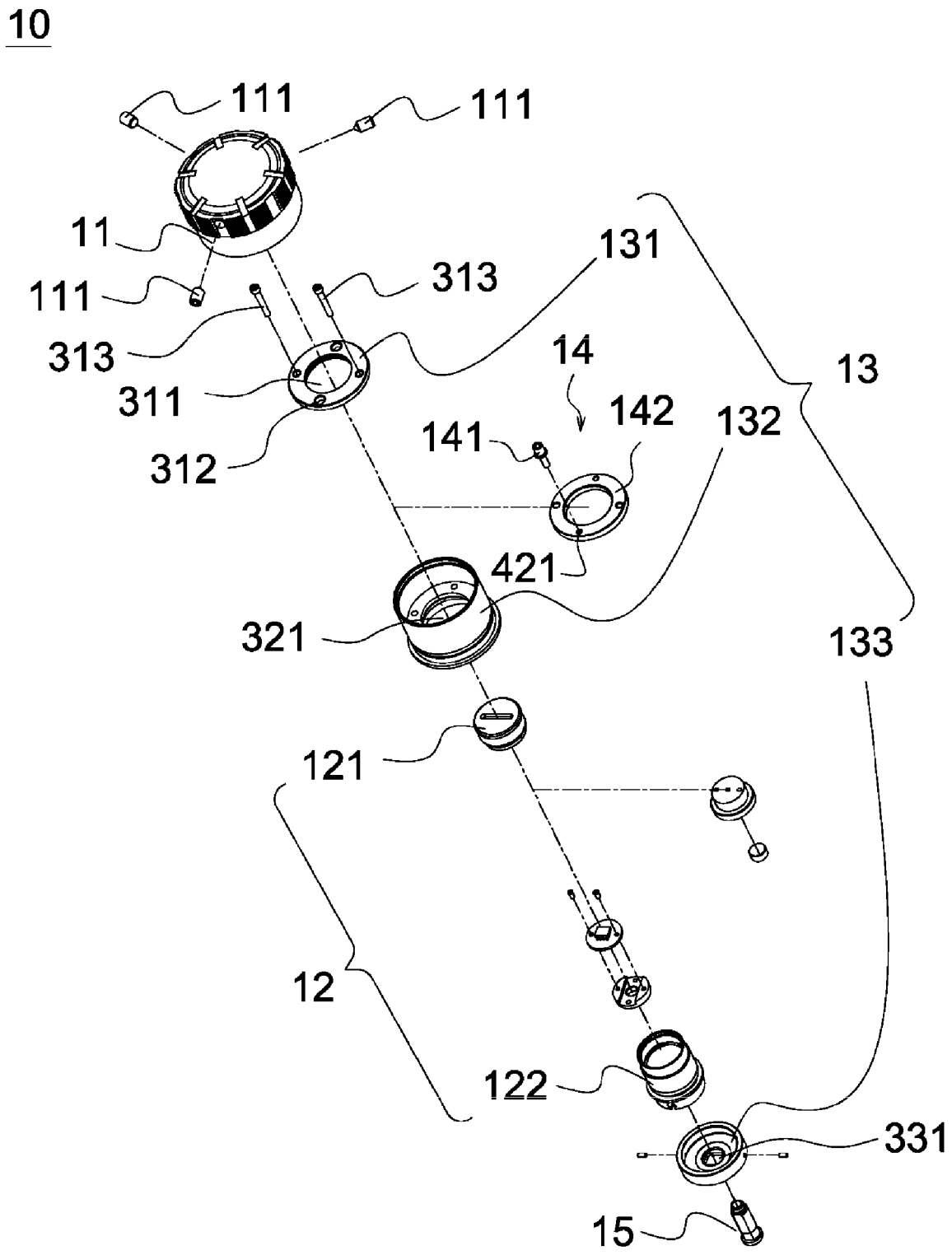
FIG. 2 is an explored diagram of the compensating mechanism of FIG. 1.

Referring to FIGS. 1 and 2, a compensating mechanism 10 of a sight in accordance with an embodiment of the invention includes an adjusting cover 11, an adjusting unit 12, a base 13, a stop unit 14 and an adjusting screw 15. In operation, a user is able to adjusting the compensating mechanism 10 by rotating the adjusting cover 11 in a predetermined direction to correct bullet impact points of a fire arm. Also, the user is able to rotate the adjusting cover 11 in a direction opposite to the predetermined direction until the adjusting cover 11 is stopped by the stop unit 14, whereby the compensating mechanism is returned to a zero-point state.

The base 13 is fixed to a main body of the sight. As shown in FIG. 1, the base 13 includes a mount cover 131, a first mount 132 and a second mount 133. The second mount 133 is disposed on the main body of the sight. The first mount 132 is disposed on the second mount 133. The mount cover 131 is disposed on an end of the first mount 132, wherein the end is farther from the second mount 133 than another end of the first mount 132. As shown in FIG. 2, the mount cover 131 has a first central hole 311, the first mount 132 has a second central hole 321, and the second mount 133 has a third central hole 331. The adjusting unit 12 is penetrated through the first central hole 311 and the second central hole 321 to be mounted in the base 13 and is rotatable with respect to the base 13. The adjusting unit 12 includes a sleeve cover 121 and a sleeve 122, wherein the sleeve 122 is rotatably disposed in the first mount 132 and the second mount 133. The sleeve cover 121 is disposed on an end of the sleeve 122, wherein the end is farther from the second mount 133 than another end of the sleeve 122.

The sleeve 122 has an adjusting hole 221 shown in FIG. 1. The adjusting screw 15 is disposed in the adjusting hole 221, is penetrated through the third central hole 331 of the second mount 133, and extended into the main body of the sight. The adjusting screw 15 has external threads (not shown) on its outer circumferential surface, the adjusting hole 221 has internal threads (not shown) on its inner circumferential surface, and the external threads and internal threads mate with each other so that a relative movement between the adjusting screw 15 and the sleeve 122 in an axial direction of the compensating mechanism 10 happens along with a relative rotation between the adjusting screw 15 and the sleeve 122. Referring to FIG. 2, the cross section of the third central hole 331 of the second mount 133 corresponds to that of the adjusting screw 15 in shape so that the adjusting screw 15 cannot be rotated with respect to the base 13 when the base 13 is stationary. Therefore, the adjusting screw 15 will only axially move with respect to the base 13 if the sleeve 122 of the adjusting unit 12 is rotated with respect to the base 13. Also, the sleeve 122, limited by the base 13 in the axial direction of the compensating mechanism 10, cannot be axially moved with respect to the base 13 when the adjusting unit 12 is rotated with respect to the base 13. In another embodiment, the sleeve 122 of the adjusting unit 12 is configured to be simultaneously rotatable and movable with respect to the base 13.

As shown in FIG. 1, the stop unit 14 is disposed between the adjusting unit 12 and the base 13 and includes a pin 141 and a rotary ring 142. The rotary ring 142 is disposed around the sleeve 122 of the adjusting unit 12 while the pin 141 is mounted on the rotary ring 142, penetrated through the mount cover 131 of the base 13, and protruded from the mount cover 131. The sleeve 122 has external threads (not shown) on its outer circumferential surface, the rotary ring 142 has internal threads (not shown) on its inner circumferential surface, and the external threads and internal threads mate with each other so that a relative movement between the rotary ring 142 and the sleeve 122 in an axial direction of the compensating mechanism 10 happens along with a relative rotation between the rotary ring 142 and the sleeve 122. Referring to FIG. 2, two fastening screws 313 are penetrated through the mount cover 131 and the rotary ring 142 and fixed to the first mount 132 of the base 13 so that the rotary ring 142 cannot be rotated with respect to the base 13. Therefore, the rotary ring 142 and the pin 141 mounted thereon will only axially move with respect to the base 13 if the sleeve 122 of the adjusting unit 12 is rotated with respect to the base 13. It is worth noting that the pin 141 can be controlled to protrude or not protrude from the mount cover 131 by rotating the sleeve 122.

In this embodiment, the pin 141 includes a nut portion 411, a flange portion 412 and a threaded portion 413. The rotary ring 142 has a threaded hole 421 as shown in FIG. 2. The nut portion 411 and the threaded portion 413 are respectively connected to the opposite sides of the flange portion 412. The threaded portion 413 is mounted on the rotary ring 142 via the threaded hole 421. The threaded portion 413 has external threads (not shown) on its outer circumferential surface, the threaded hole 421 has internal threads (not shown) on its inner circumferential surface, and the external threads and internal threads mate with each other so that a relative movement between the rotary ring 142 and the pin 141 in an axial direction of the compensating mechanism 10 happens along with a relative rotation between the rotary ring 142 and the pin 141. In this embodiment, the mount cover 131 has a through hole 312 for receiving the nut portion 411 as shown in FIG. 2. An outer diameter of the flange portion 412 is greater than that of the nut portion 411 and also greater than an inner diameter of the through hole 312. When the pin 141 is axially moved toward the mount cover 131, the nut portion 411 can pass through the through hole 312 but the flange portion 412 is blocked by the bottom of the mount cover 131 where the flange portion 412 is propped against the mount cover 131. When the flange portion 412 is propped against the mount cover 131, the nut portion 411 is protruded from the mount cover 131.

Figure 3:
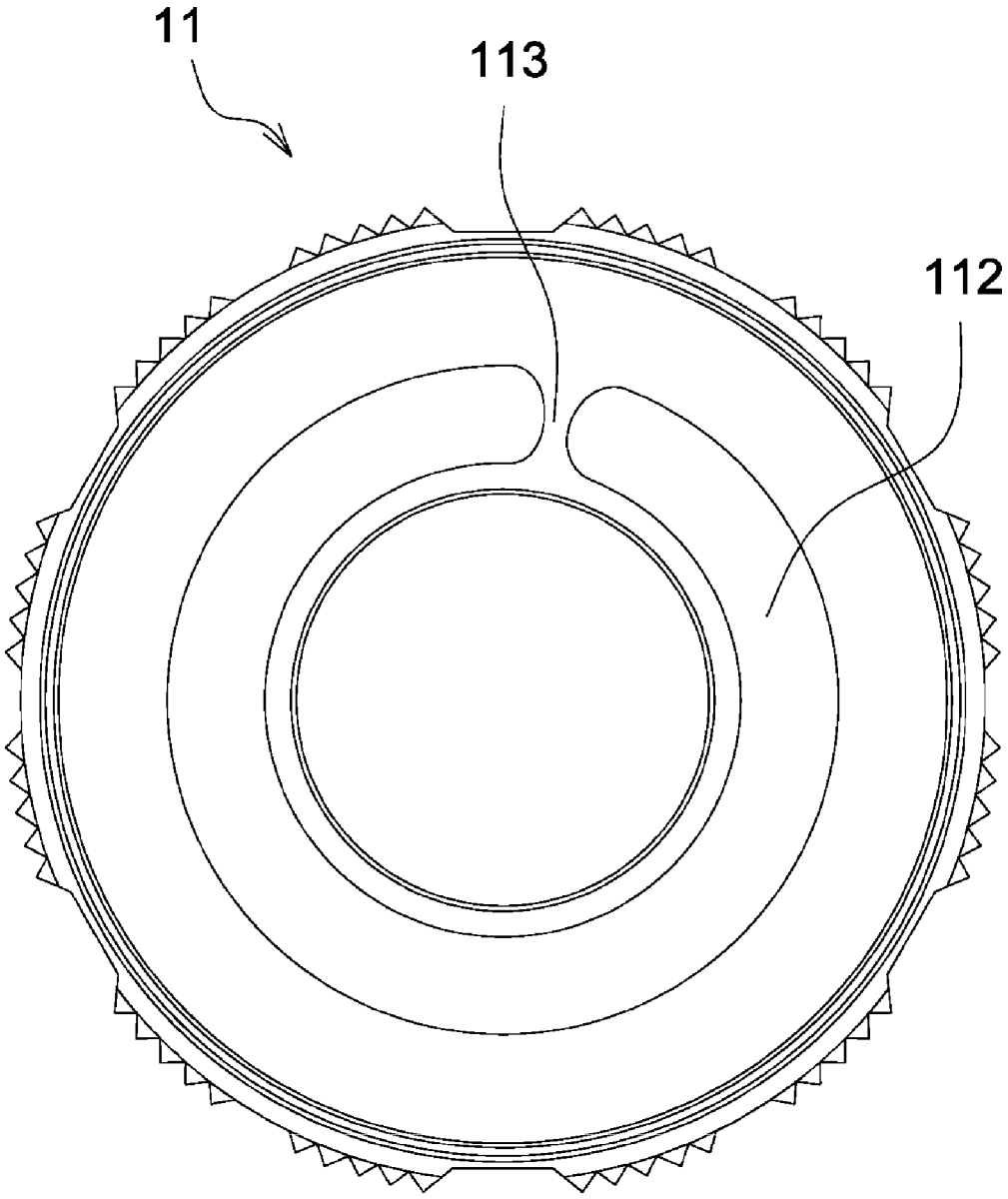
FIG. 3 is a bottom view of the adjusting cover of the compensating mechanism of FIG. 1.

Referring to FIG. 1, the adjusting cover 11 is fixed to the sleeve cover 121 of the adjusting unit 12 by a plurality of screws 111, so that the adjusting cover 11 in rotation can drive the adjusting unit 12 to rotate with respect to the base 13. Referring to FIG. 3, the adjusting cover 11 has a surface facing the base 13, on which a curved groove 112 and a blocking portion 113 are formed and arranged to form a complete circle. When the flange portion 412 is propped against the bottom of the mount cover 131, the pin 141 is protruded from the mount cover 131 and enters the curved groove 112. By such arrangement, the pin 141 may contact the blocking portion 113 to limit the rotation of the adjusting cover 11.

Before the bullet impact points are corrected, it is required to set the compensating mechanism 10 to a zero-point state wherein the adjusting screw 15 of the compensating mechanism 10 is adjusted to be located in a reference position and the pin 141 of the stop unit 14 is adjusted to be located in the curved groove 112 of the adjusting cover 11 and to be propped against the blocking portion 113. In detail, the user removes the adjusting cover 11 and manually rotates the adjusting unit 12 until the adjusting screw 15 is axially moved to the reference position. Due to the rotation of the adjusting unit 12, the pin 141 and the rotary ring 142 are axially moved with respect to the base 13. However, the pin 141 may have not entered the curved groove 112. If so, the user can rotate the pin 141 so that the pin 141 is moved with respect to the rotary ring 142 in the axial direction of the mount cover 131 until the flange portion 412 is propped against the bottom of the mount cover 131. During rotation of the pin 141, the pin 141 cannot drop or separate from the mount cover 131 because the outer diameter of the flange portion 412 is greater than that of the nut portion 411 and also greater than the inner diameter of the through hole 312. After adjusting the blocking portion 113 of the adjusting cover 11 to contact the pin 141, the user fixes the adjusting cover 11 to the adjusting unit 12 to complete the zero-point-state setting. It is noted that the adjusting cover 11 is in a zero-point position when the pin 141 is adjusted to be located in the curved groove 112 and propped against the blocking portion 113.

After the zero-point state is set, the user can operate the compensating mechanism 10 to correct the bullet impact points of a firearm. At the beginning, the adjusting cover 11 under the limitation of the stop unit 14 can only be rotated in a predetermined direction (e.g. counterclockwise). Once the adjusting cover 11 is rotated in the predetermined direction, the pin 141 separates from the blocking portion 113 to release the adjusting cover 11 from the stop unit 14. Therefore, the rotation of the adjusting cover 11 is no longer limited to the predetermined direction. During the operation of correcting bullet impact points, the adjusting cover 11 is rotated for driving the adjusting unit 12 to rotate with respect to the base 13 and for driving the adjusting screw 15 to axially move with respect to the base 13 until the adjusting screw 15 is moved to a predetermined position. Also, during the rotation of the adjusting unit 12, the pin 141 and the rotary ring 142 are axially moved with respect to the base 13 and away from the mount cover 131 so that the pin 141 leaves the curved groove 112.

During the process of correcting the bullet impact points, the user is able to return the compensating mechanism 10 to the zero-point state at any time. In detail, the user can rotate the adjusting cover 11 in a direction opposite to the predetermined direction (e.g. clockwise) to rotate the adjusting unit 12 so that the adjusting screw 15 is axially moved to leave the predetermined position. During the process of rotation of the adjusting unit 12, the pin 141 and the rotary ring 142 are axially moved with respect to the base 13 and toward the mount cover 131 until the flange portion 412 is propped against the bottom of the mount cover 131. Then, the pin 141 enters the curved groove 112, the blocking portion 113 of the adjusting cover 11 is propped against the pin 141, and the adjusting cover 11 is limited by the stop unit 14 to stop in the zero-point position where the adjusting cover 11 cannot be further rotated in the direction opposite to the predetermined direction. At that time, the adjusting screw 15 is returned to the reference position, and the compensating mechanism is returned to the zero-point state.

Due to use of the stop unit 14, the user only needs to reversely rotate the adjusting cover 11 and the compensating mechanism 10 can rapidly return to the zero-point state. Therefore, operation of the compensating mechanism 10 becomes easier and intuitional.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A compensating mechanism, comprising:
- a base;
- an adjusting unit disposed in the base;
- an adjusting cover connecting to the adjusting unit and comprising a curved groove; and
- a stop unit which is disposed between the adjusting unit and the base and comprises a pin;
- wherein when the adjusting cover is rotated, the adjusting unit is only rotated with respect to the base and the stop unit is axially moved with respect to the base so that the pin enters or leaves the curved groove.

2. The compensating mechanism as claimed in claim 1, wherein the stop unit further comprises a rotary ring disposed around the adjusting unit, the pin is disposed on the rotary ring, and the rotary ring and the pin are axially moved with respect to the base when the adjusting cover is rotated.

3. The compensating mechanism as claimed in claim 2, wherein the rotary ring is rotated with respect to the adjusting unit when the adjusting cover is rotated.

4. The compensating mechanism as claimed in claim 2, wherein, when rotated, the pin is axially moved with respect to the rotary ring.

5. The compensating mechanism as claimed in claim 2, wherein the base comprises a mount cover, the pin comprises a flange portion, and the pin is protruded from the mount cover and penetrated into the curved groove when the flange portion is propped against the mount cover.

6. The compensating mechanism as claimed in claim 5, further comprising a fastening screw which is sequentially penetrated through the mount cover and the rotary ring and fixed to the base to prevent the rotary ring from rotating with respect to the base.

7. The compensating mechanism as claimed in claim 5, wherein the mount cover has a through hole, the pin further comprises a nut portion and a threaded portion respectively connected to opposite sides of the flange portion, the threaded portion is threaded onto the rotary ring, and the nut portion is penetrated through the through hole of the mount cover.

8. The compensating mechanism as claimed in claim 7, wherein an outer diameter of the flange portion is greater than that of the nut portion and also greater than an inner diameter of the through hole.

9. The compensating mechanism as claimed in claim 1, wherein the adjusting cover further comprises a blocking portion, and the blocking portion and the curved groove are configured to form a complete circle.

10. The compensating mechanism as claimed in claim 1, further comprising an adjusting screw disposed in the adjusting unit and penetrated through the base, wherein the adjusting screw is axially moved with respect to the base when the adjusting cover is rotated.

11. A compensating mechanism, comprising:
- a base;
- an adjusting unit disposed in the base;
- an adjusting cover connecting to the adjusting unit and comprising a curved groove; and
- a stop unit which is disposed between the adjusting unit and the base and comprises a pin;
- wherein when the adjusting cover is rotated, an axial distance between the adjusting cover and the base is fixed and the stop unit is axially moved with respect to the base so that the pin enters or leaves the curved groove.

12. The compensating mechanism as claimed in claim 11, wherein the stop unit further comprises a rotary ring disposed around the adjusting unit, the pin is disposed on the rotary ring, and the rotary ring and the pin are axially moved with respect to the base when the adjusting cover is rotated.

13. The compensating mechanism as claimed in claim 12, wherein the rotary ring is rotated with respect to the adjusting unit when the adjusting cover is rotated.

14. The compensating mechanism as claimed in claim 12, wherein, when rotated, the pin is axially moved with respect to the rotary ring.

15. The compensating mechanism as claimed in claim 12, wherein the base comprises a mount cover, the pin comprises a flange portion, and the pin is protruded from the mount cover and penetrated into the curved groove when the flange portion is propped against the mount cover.

16. The compensating mechanism as claimed in claim 15, further comprising a fastening screw which is sequentially penetrated through the mount cover and the rotary ring and fixed to the base to prevent the rotary ring from rotating with respect to the base.

17. The compensating mechanism as claimed in claim 15, wherein the mount cover has a through hole, the pin further comprises a nut portion and a threaded portion respectively connected to opposite sides of the flange portion, the threaded portion is threaded onto the rotary ring, and the nut portion is penetrated through the through hole of the mount cover.

18. The compensating mechanism as claimed in claim 17, wherein an outer diameter of the flange portion is greater than that of the nut portion and also greater than an inner diameter of the through hole.

19. The compensating mechanism as claimed in claim 11, wherein the adjusting cover further comprises a blocking portion, and the blocking portion and the curved groove are configured to form a complete circle.

20. The compensating mechanism as claimed in claim 11, further comprising an adjusting screw disposed in the adjusting unit and penetrated through the base, wherein the adjusting screw is axially moved with respect to the base when the adjusting cover is rotated.

* * * * *